US011523662B2

(12) United States Patent
Boucard et al.

(10) Patent No.: US 11,523,662 B2
(45) Date of Patent: Dec. 13, 2022

(54) ASSEMBLY OF ELEMENTS SUCH AS BRACELET LINKS

(71) Applicant: Comadur SA, Le Locle (CH)

(72) Inventors: Sylvain Boucard, Villers-le-Lac (FR); Alain Geiser, Murten (CH)

(73) Assignee: Comadur SA, Le Locle (CH)

( * ) Notice: Subject to any disclaimer, the term of this patent is extended or adjusted under 35 U.S.C. 154(b) by 570 days.

(21) Appl. No.: 16/654,212

(22) Filed: Oct. 16, 2019

(65) Prior Publication Data

US 2020/0146403 A1 May 14, 2020

(30) Foreign Application Priority Data

Nov. 13, 2018 (EP) ..... 18205997

(51) Int. Cl.
*A44C 5/10* (2006.01)
*A44C 5/02* (2006.01)

(52) U.S. Cl.
CPC ..... *A44C 5/107* (2013.01); *A44C 5/027* (2013.01)

(58) Field of Classification Search
CPC . A44C 5/107; A44C 5/105; Y10T 403/32951; Y10T 403/32959; Y10T 403/32967
See application file for complete search history.

(56) References Cited

U.S. PATENT DOCUMENTS

| | | | | |
|---|---|---|---|---|
| 9,345,292 | B2 * | 5/2016 | Geiser | A44C 5/107 |
| 2012/0198885 | A1 | 8/2012 | Bolzt et al. | |
| 2014/0338398 | A1 | 11/2014 | Geiser et al. | |

FOREIGN PATENT DOCUMENTS

| | | | |
|---|---|---|---|
| CH | 704 493 | A2 | 8/2012 |
| CN | 1334055 | A | 2/2002 |
| CN | 1343473 | A | 4/2002 |
| CN | 1192730 | C | 3/2005 |
| CN | 102626266 | A | 8/2012 |
| CN | 104161356 | A | 11/2014 |
| EP | 1 967 087 | A1 | 9/2008 |
| EP | 2 484 246 | A1 | 8/2012 |
| EP | 2 803 286 | A1 | 11/2014 |
| JP | 2000-179511 | A | 6/2000 |
| JP | 3137121 | U | 11/2007 |
| JP | 2014-226549 | A | 12/2014 |

(Continued)

OTHER PUBLICATIONS

Korean Office Action dated Dec. 24, 2020 in Korean Patent Application No. 10-2019-0136258 (with English translation), 10 pages.

(Continued)

*Primary Examiner* — Jack W Lavinder

(74) *Attorney, Agent, or Firm* — Oblon, McClelland, Maier & Neustadt, L.L.P.

(57) ABSTRACT

An item includes at least two sets of assembled elements that are connected to each other by a permanent securing device. The permanent securing device includes a pin mounted in a through hole of a central element of a set. This pin is mounted at each end in a blind recess of a side element belonging to another set. At one end, the pin is secured in the blind recess by a locking device, for example by a screw connection. At its other end, it is welded to a socket which is itself secured by a locking device in the blind recess of the side element.

8 Claims, 3 Drawing Sheets

(56) References Cited

FOREIGN PATENT DOCUMENTS

| | | | |
|---|---|---|---|
| JP | 5841191 | B2 | 1/2016 |
| WO | WO 2009/020186 | A1 | 2/2009 |

OTHER PUBLICATIONS

European Search Report dated Mar. 19, 2019 in European Application 18205997.2 filed on Nov. 13, 2018 (with English Translation of Categories of Cited Documents).
Combined Chinese Office Action and Search Report dated Mar. 29, 2021 in corresponding Chinese Patent Application No. 201911099265.0 (with English Translation and English Translation of Category of Cited Documents), 11 pages.
Japanese Office Action dated Jan. 12, 2021 in Japanese Patent Application No. 2019-198408 (with English translation), 8 pages.
Korean Office Action dated Jun. 29, 2021 in Korean Patent Application No. 10-2019-0136258 (with English translation), 9 pages.

* cited by examiner

ASSEMBLY OF ELEMENTS SUCH AS BRACELET LINKS

CROSS-REFERENCE TO RELATED APPLICATION

This application claims priority to European Patent Application No. 18205997.2 filed on Nov. 13, 2018, the entire disclosure of which is hereby incorporated herein by reference.

FIELD OF THE INVENTION

The invention relates to an assembly of elements and more specifically to an item comprising several sets of elements assembled to each other. The elements may form the links of a bracelet, of a decorative article or of a jewelry item.

PRIOR ART

There is known from EP Patent No. 2803286 a link assembly system where at least a part of the links is made of a hard material, such as diamond or ceramic, allowing little or no plastic deformation during assembly. In the illustrative case of a bracelet, the latter is a result of the assembly of several assembly systems. For a three-row bracelet, each assembly system comprises two external links and one central link. The external links each have a blind hole and the central link has a through hole. The assembly system includes a pin mounted in the through hole of the central link. The pin has, at one end, an external thread cooperating with an internal thread provided in the blind hole of one of the external links. At its other end, the pin is press-fitted and welded in a socket screwed into the blind hole of the other external link. This assembly system makes it possible to secure the three rows of links without plastic deformation of the external links, with a permanent fastening made by welding the pin in the socket. Next, or concomitantly, the assembly system is secured to another assembly system and so on to form the bracelet. In order to assemble two assembly systems to each other, each external link has a second (blind or through) hole and each central link has a second through hole. The second hole of each external link of an assembly system is respectively intended to receive one end of a pin which is mounted in the second through hole of the central link of another assembly system. The ends of the pin ensuring the assembly between the two assembly systems are freely mounted in the external links. In practice, it is observed that it is not optimal to assemble the two assembly systems in this manner. Indeed, the external links can move slightly from their initial position revealing a gap with the central link, which impairs the aesthetic appearance of the bracelet.

SUMMARY OF THE INVENTION

It is an object of the present invention to overcome the aforementioned drawbacks by proposing a mounting arrangement between the assembly systems that makes the item obtained more rigid to avoid any such movement of the external links.

To this end, the invention relates to an item comprising at least two assembly systems, which will be referred to here as sets of assembled elements, connected to each other by a permanent securing device. According to the invention, the permanent securing device comprises a pin mounted in a through hole of a central element of a set. This pin is mounted at each end in a blind recess of a side element belonging to another set. At one end, the pin is secured in the blind recess by locking means, for example by a screw connection. At its other end, it is welded to a socket which is itself secured by locking means inside the blind recess of the side element. Alternatively, the other end is driven into the socket which is itself secured by locking means inside the blind recess of the side element. The item of the invention is defined according to claim 1.

The addition of a permanent securing device to connect the sets to each other stiffens the bracelet by limiting deformation during bending, extension or twisting and thereby maintains the original aesthetics.

Other features and advantages of the present invention will appear more clearly from the following description of a preferred embodiment, provided by way of non-limiting example, with reference to the annexed drawings.

DETAILED DESCRIPTION

Figure 1:
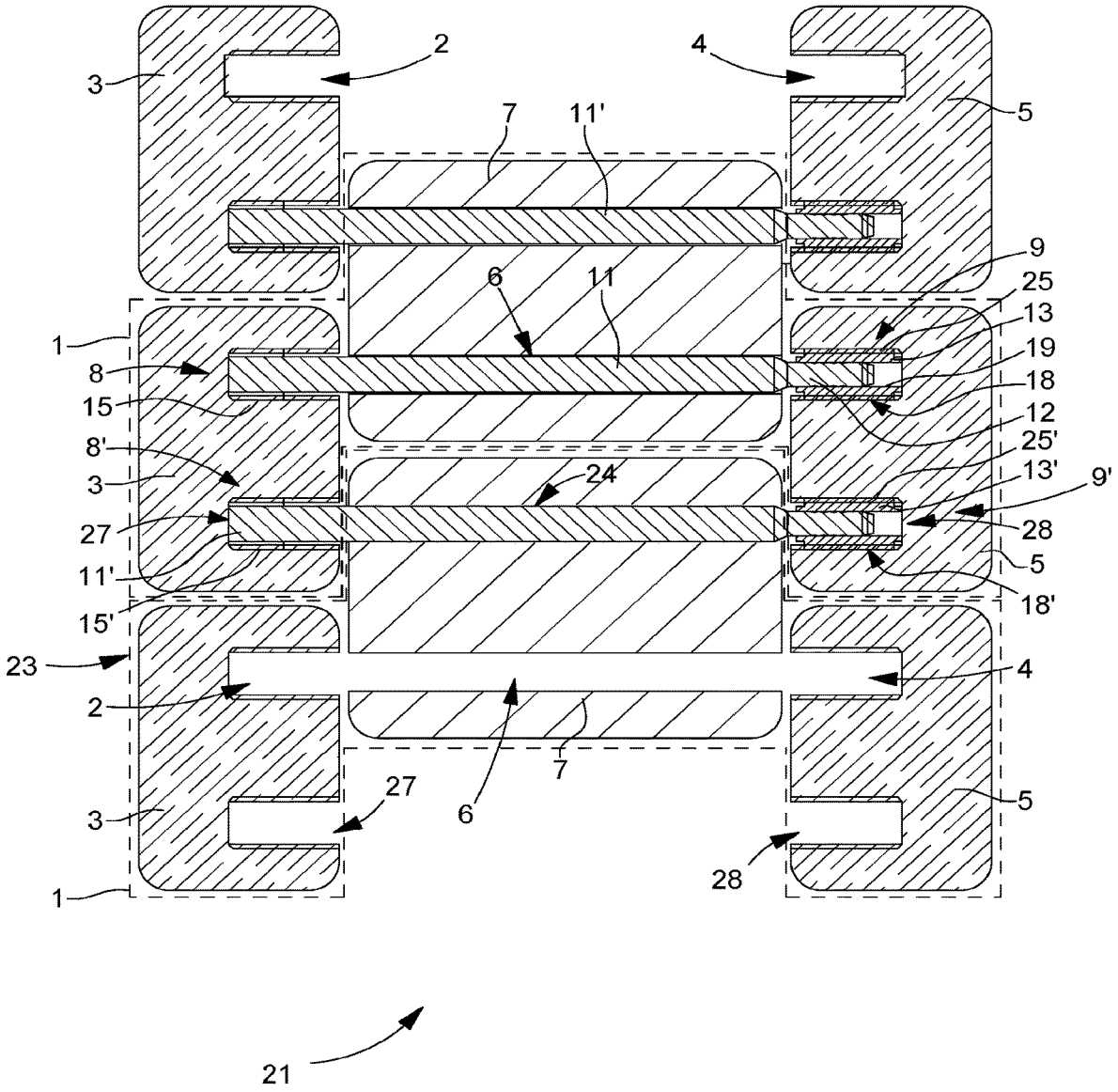
FIG. 1 is a sectional view along the longitudinal axis of an item according to the invention.

The present invention relates to a mounting arrangement or a means of assembly between at least two sets of assembled elements. Said elements are, for example, links intended to form a bracelet, a decorative article or a jewelry item. The means of assembly is more specifically suited for assembling elements made wholly or partly of hard materials. The term "hard materials" according to the invention refers to materials whose hardness is substantially equal to or greater than 600 HV and which allow little or no plastic deformation before breaking. By way of non-limiting example, the following may be cited as hard materials: enamels, precious or non-precious stones, such as ruby, sapphire or quartz, ceramics such as a metallic or non-metallic oxide, carbide or nitride, or hard metals.

According to the invention, each set includes elements assembled in a similar manner to that described in EP 2803286. Concomitantly to the assembling of the elements in each set, the sets are assembled to each other by means of a permanent securing device.

Prior to detailing this means of assembling the sets to each other, the assembly within each set of elements is described with reference to Patent No. EP 2803286. Each set 1, delimited by dotted lines in FIG. 1, includes at least three elements 3, 5, 7 which may be wholly or partly made of hard materials. It includes a first side element 3 and a second side element 5 which are substantially symmetrical relative to a third element 7 arranged between the side elements. It is noted that elements 3, 5, 7 are preferably arranged in a quincunx pattern.

First and second elements 3, 5 each include a first blind recess 2, 4, whereas third element 7 includes a first through hole 6. As shown in FIG. 1, recesses 2, 4 and hole 6 are intended to be aligned in order to secure the first, second and third elements 3, 5, 7 to each other. To this end, set 1 includes a permanent securing device 9 in order to non-removably secure the first, second and third elements 3, 5, 7 to each other.

Figure 2:
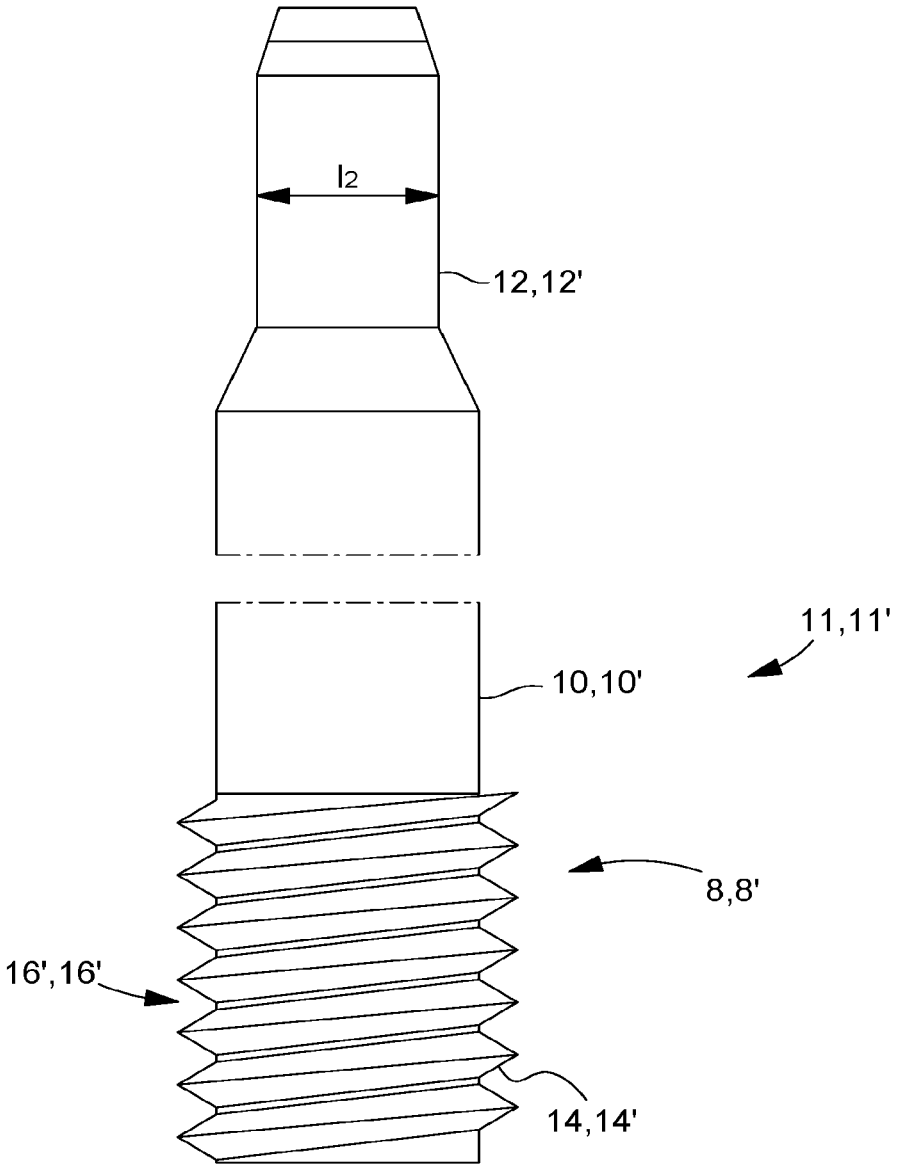
FIG. 2 is a partial view of a pin according to the invention.

Permanent securing device 9 includes a pin 11 mounted in through hole 6 of central third element 7. At a first end, pin 11 includes a first means 8 of locking inside first blind recess 2 of element 3. As seen more clearly in FIG. 2, pin 11 includes three single-piece portions 14, 10, 12. The main portion 10 of pin 11 has a cross-section of intermediate size relative to the other two portions and is intended to be received in through hole 6 of third element 7. Depending on the play allowed or the respective shape of through hole 6 and of portion 10, the first and second lateral elements 3, 5 may or may not be able to pivot relative to central third element 7. By way of non-limiting example, through hole 6 may have a cross-section of non-circular shape matching that of portion 10 of pin 11 to prevent any relative pivoting of the first, second and third elements 3, 5, 7. Conversely, it is possible to envisage through hole 6 having a circular cross-section matching that of portion 10 of pin 11 to allow the pivoting of central third element 7 relative to first and second side elements 3, 5.

Portion 14 of pin 11 forms said first end where said first locking means 8 is located. In the example seen in FIGS. 1 to 3, first locking means 8 is formed by an internal thread 15 arranged in blind recess 2 of first element 3 and by an external thread 16 on the first end, namely portion 14, of pin 11. Finally, portion 12 of pin 11 has the smallest cross-section of pin 11 and is intended to be received in a socket 13 of permanent securing device 9.

Figure 3:
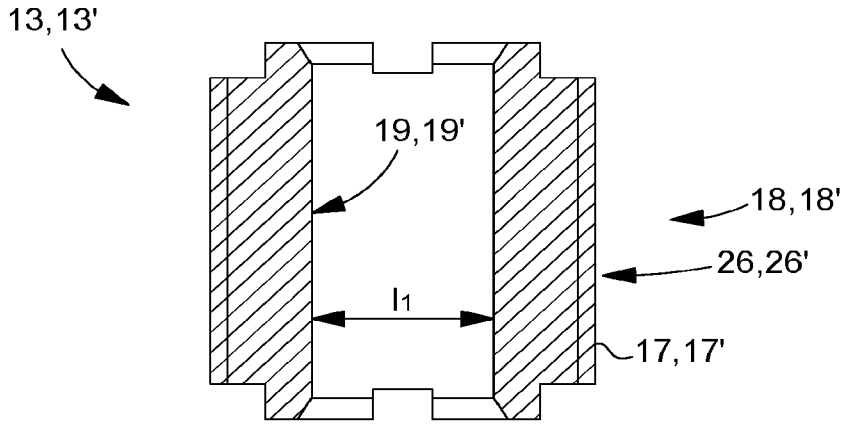
FIG. 3 is a sectional view of a socket according to the invention.

The socket 13 represented in more detail in FIG. 3 includes, on its external wall 17, second means 18 of locking inside blind recess 4 of second element 5. In the example seen in FIGS. 1 to 3, second locking means 18 is formed by an internal thread 25 present in blind recess 4 of second element 5 and by an external thread 26 on external wall 17 of socket 13. Internal wall 19 of socket 13 is welded to the second end, namely portion 12, of pin 11 in order to secure the first, second and third elements 3, 5, 7 to each other with no plastic deformation of first and second elements 3, 5.

Figure 4:
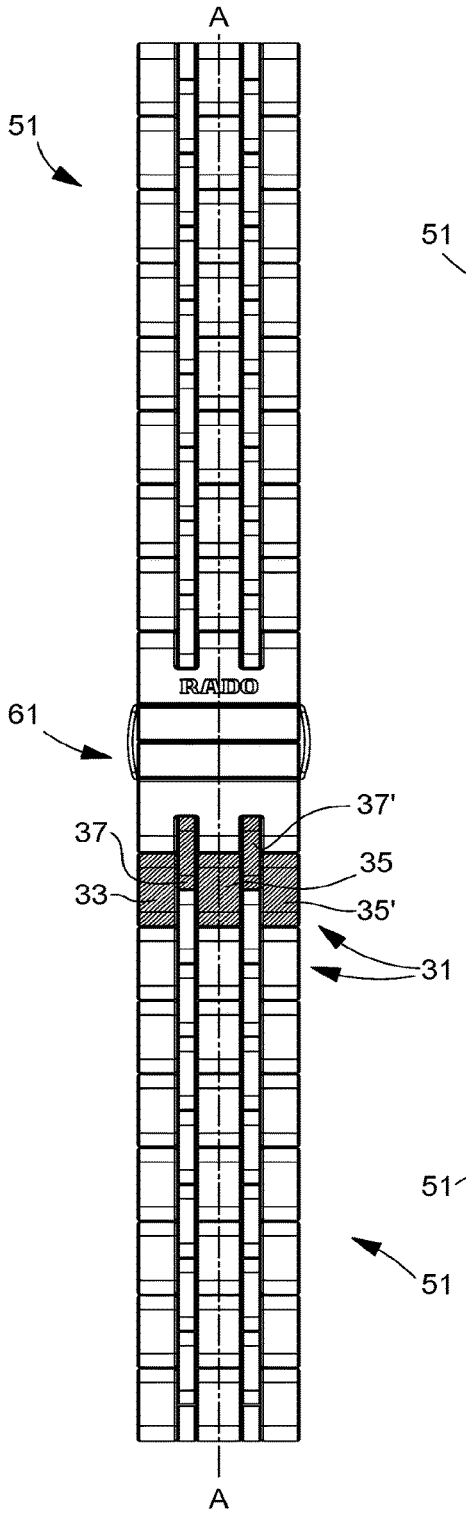
FIG. 4 is a top view of another item according to the invention.
Figure 5:
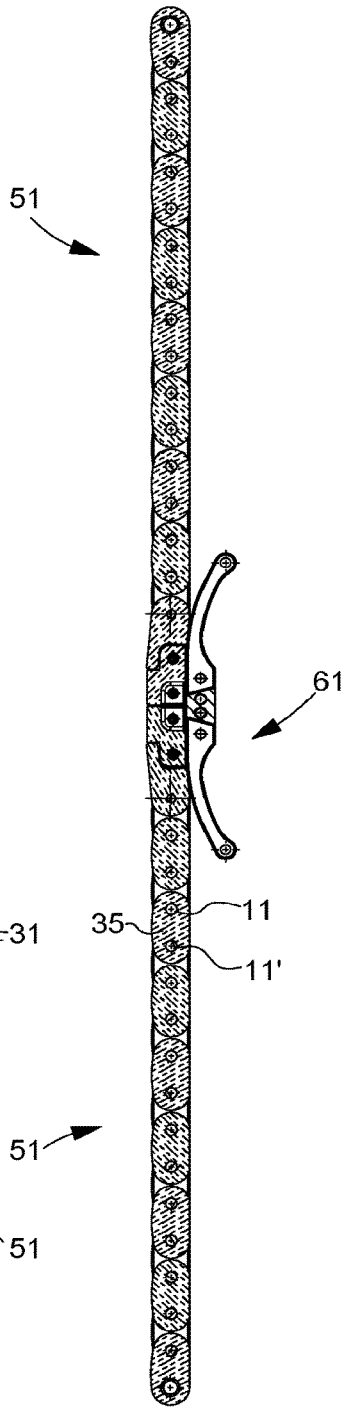
FIG. 5 is a sectional view along axis A-A of FIG. 4.
Figure 6:
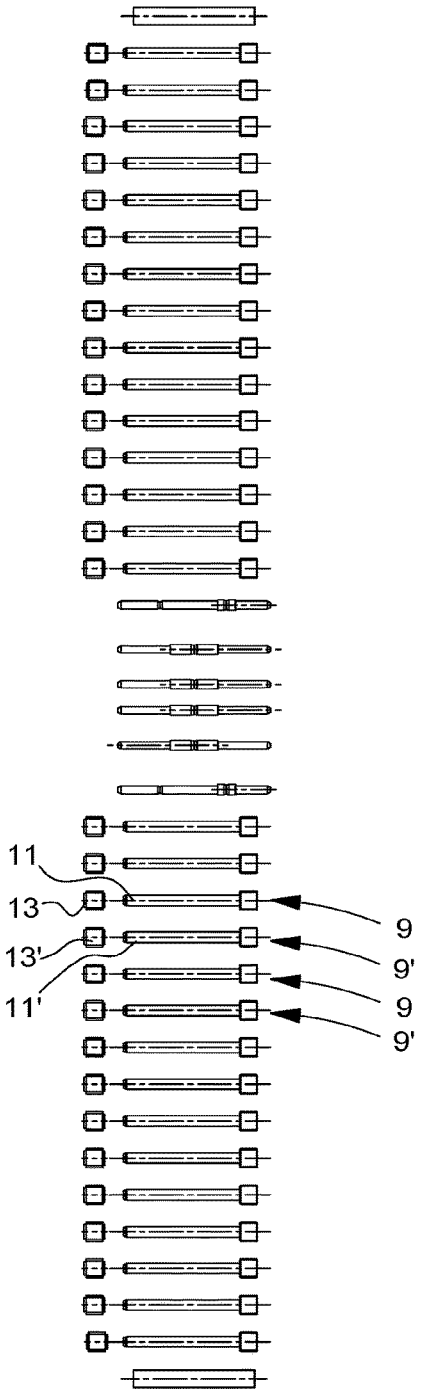
FIG. 6 is a view of the securing devices used for the item of FIG. 4.

In a variant presented in FIGS. 4 to 6, each set 31 has five elements. Indeed, in addition to the three elements 33, 35', 37 which are comparable to those 3, 5, 7 of the first type of set 1, the second type of set 31 includes a separator row with a central second element 37' and an intermediate element 35.

This set 1, 31 is assembled with another set and so on in order to form an item, such as, for example, a bracelet, a decorative article or a jewelry item.

The invention therefore relates to an item 21, 51 comprising at least two sets 1, 31. According to the invention, the two sets 1, 31 are also connected to each other by a permanent securing device 9'.

Referring to item 21 of FIG. 1, permanent securing device 9' includes a pin 11' mounted in a second through hole 24 of third element 7 of a set 1. Each end of pin 11' is respectively mounted in a second blind recess 27, 28 made in first and second elements 3, 5 of another adjacent set 1. The pin 11' intended to be mounted in second through hole 24 has a similar configuration to that intended to be mounted in first through hole 6. It thus includes, as in FIG. 2, three single piece portions 10', 12', 14', with a first end 14' where locking means 8' is located, formed by an external thread 16' cooperating with an internal thread 15' arranged in second blind recess 27 of first element 3. Finally, the second end 12' of pin 11' has a smaller cross-section than that of central portion 10'. It is intended to be received in a socket 13' of permanent securing device 9'. This socket 13' is mounted in second blind recess 28 of second element 5 also with locking means 18'. It has a similar configuration to that of FIG. 3 with locking means 18' formed by an internal thread 25' arranged in blind recess 28 of second element 5 and by an external thread 26' on external wall 17' of socket 13'. Internal wall 19' of socket 13' is welded to the second end, i.e. to portion 12' of pin 11' in order to secure the two sets 1 to each other to form item 21.

It is clear that, as for first through hole 6, depending on the play allowed or the respective shape of through hole 24 and of pin 11', third central element 7 may or may not be able to pivot with respect to the first and second side elements 3, 5 which surround it. Just as for first through hole 6, through hole 24 may have a cross-section of non-circular shape matching that of pin 11' to prevent any relative pivoting between the third element and the first and second side elements. Conversely, it is possible to envisage through hole 24 having a circular cross-section matching that of pin 11' to allow such relative pivoting.

For item 51 seen in FIGS. 4-6, as in the explanation above, item 51 includes permanent securing devices 9 within each set 31 (a pin 11 secured on a socket 13) alternating with permanent securing devices 9' (a pin 11' secured on a socket 13') between sets. It is to be noted, however, that pins 11, 11' no longer include a second end of smaller cross-section than the main portion. It is thus clear that this reduced cross-section is merely optional both for this type of item and for that of FIGS. 1 to 3. It is also be noted that several sets 31 can be connected to each other by a clasp 61 to form a bracelet or watchband intended to be mounted on a watch case middle.

The method for assembling sets 1 is explained below. In a first step, elements 3, 5, 7 are made, for example, with the various holes or recesses 2, 4, 6, 27, 28, 24 which are formed immediately or machined afterwards. In a second step, sockets 13 and 13' are mounted in recesses 4 and 28 respectively of side element 5 via locking means 18 and 18'. In a third step, pins 11, 11' are mounted in recesses 2 and 27 respectively of side element 3 via locking means 8 and 8'. Of course, the second and third steps can be inverted.

In a fourth step, portions 10, 10' and 12, 12' of pins 11, 11' projecting from first side element 3 are respectively fitted, as regards first pin 11, in first through hole 6 of a third element 7 of a set 1, and as regards second pin 11', in second through hole 24 of the third element 7 of an adjacent set 1. In a fifth step, the second end of each pin 11, 11', i.e. portion 12, 12', projecting from third elements 7 is press fitted against internal wall 19, 19' of each socket 13, 13' mounted in second side element 5.

Finally, in a sixth and final step, the second end of each pin 11, 11', is welded to the internal wall 19, 19' of the corresponding socket 13, 13'. This welding is advantageously contact free and preferably uses magnetic induction heating. Consequently, it is clear that pins 11, 11' and sleeves 13, 13' are preferably formed by an electrically conductive material like a metal, such as steel, for example. Advantageously, the press-fitting operation performed in the fifth step facilitates welding in the sixth step and avoids heating the sets for too long. At the end of the sixth and final step, the elements 3, 5 and 7 of each set are completely integral, as are the sets with one another, and can only be disassembled by breaking the weld between sockets 13, 13' and pins 11, 11'.

If there are more than three elements as illustrated in FIGS. 4 to 6, the principle is substantially the same with elements 37, 37' forming the third central element. The first and second through holes of these elements 37, 37' communicate with two through holes respectively arranged in the intermediate elements 35 of two adjacent sets 31 to respectively receive two pins 11, 11' extending between side elements 33, 35' provided with blind recesses.

Of course, this invention is not limited to the illustrated examples but is capable of different variants and modifications that will appear to those skilled in the art. In particular, the various locking means 8, 8', 18, 18' may be of a different nature to devices of the internal thread 15, 15', 25, 25'/external thread 16, 16', 26, 26' type and/or be of a different nature from each other. By way of non-limiting example, one or more locking means could also be formed by bayonet devices providing durable, low-stress attachment like the internal/external thread devices.

In a variant, the first and second pins can be made of titanium and in such case, said ends 12, 12' of the pins are driven into said second sockets 13, 13', which are also preferably made of titanium. The use of titanium for the pins and sockets has the particular advantage of providing a more rigid attachment of the links than with steel pins thereby improving the resistance of the bracelet.

Further, the number, dimensions and geometry of the elements for each set may be different without losing the advantages of the invention.

The invention claimed is:

1. An item comprising:

at least two sets of elements assembled to each other, each set comprising a first, a second and a third element with the first element and the second element disposed on either side of the third element, the first and the second elements each including a first and a second blind recess and the third element comprising a first and a second through hole, the first through hole of the third element being placed opposite the first blind recess of the first and second elements of each set, the second through hole of the third element of one set being placed opposite the second blind recess of the first and second elements of another set, each set includes a permanent securing device including:

a first pin mounted in the first through hole of the third element and in the first blind recess of the first and second elements, the first pin including, at one end mounted in the first blind recess of the first element, first locking means, a first socket disposed in the first blind recess of the second element, an external wall of the first socket comprising second locking means in said first blind recess of the second element and an internal wall being welded to the other end of the first pin or said other end being press-fitted into said first socket, wherein the item comprises another permanent securing device connecting said at least two sets, said another permanent securing device comprising:

a second pin mounted in the second through hole of the third element of the one set and in the second blind recess of the first and second elements of said another set, the second pin including, at one end mounted in the second blind recess of the first element of said another set, third locking means, a second socket disposed in the second blind recess of the second element of said another set, an external wall of the second socket of said another set comprising fourth locking means in said second blind recess of the second element of said another set and an internal wall of the second socket of said another set being welded to the other end of the second pin or said other end being press-fitted into said second socket of the second element of said another set.

2. The item according to claim 1, wherein the first, second, third and/or fourth locking means are foil led by a device of the internal/external thread type or of the bayonet type.

3. The item according to claim 1, wherein at least one portion of the first and second elements is formed with enamel and/or stone and/or ceramic.

4. The item according to claim 1, wherein, in each set, the third element is formed of several elements with an intermediate element disposed between each of said several elements.

5. The item according to claim 1, wherein the first through hole and/or the second through hole of the third element have a cross-section of non-circular shape matching that of the first and second pins respectively, in order to prevent any relative pivoting of the first, second and third elements.

6. The item according to claim 1, wherein the first through hole and the second through hole of the third element have a cross-section of circular shape matching that of the first and second pins, in order to allow the pivoting of the third element with respect to the first and second elements.

7. The item according to claim 1, wherein the item comprises at least five of the sets connected to one another by the other permanent securing device to form a bracelet, a decorative article or a jewelry item.

8. The item according to claim 1, wherein the first and second pins and the second sockets are made of titanium and wherein said other ends of the pins are driven into said second sockets.

* * * * *